US009293106B2

(12) United States Patent
Hong et al.

(10) Patent No.: US 9,293,106 B2
(45) Date of Patent: Mar. 22, 2016

(54) DISPLAY DEVICE AND DRIVING METHOD THEREOF

(71) Applicant: SAMSUNG DISPLAY CO., LTD., Yongin, Gyeonggi-Do (KR)

(72) Inventors: Seok Ha Hong, Yongin (KR); Dae-Gwang Jang, Yongin (KR); Byung Sun Kim, Yongin (KR); Sang Mi Kim, Yongin (KR); Ung Gyu Min, Yongin (KR); Hyun Sik Hwang, Yongin (KR); Gi Geun Kim, Yongin (KR); Kyoung Won Lee, Yongin (KR)

(73) Assignee: SAMSUNG DISPLAY CO., LTD., Yongin, Gyunggi-Do (KR)

( * ) Notice: Subject to any disclaimer, the term of this patent is extended or adjusted under 35 U.S.C. 154(b) by 255 days.

(21) Appl. No.: 14/146,792

(22) Filed: Jan. 3, 2014

(65) Prior Publication Data

US 2014/0313181 A1 Oct. 23, 2014

(30) Foreign Application Priority Data

Apr. 22, 2013 (KR) ..... 10-2013-0044345

(51) Int. Cl.
*G09G 3/36* (2006.01)

(52) U.S. Cl.
CPC ..... *G09G 3/3696* (2013.01); *G09G 3/3648* (2013.01); *G09G 2320/0247* (2013.01); *G09G 2320/103* (2013.01); *G09G 2340/0435* (2013.01)

(58) Field of Classification Search
CPC ..... G09G 3/3696; G09G 3/3648; G09G 2320/0247; G09G 2320/103; G09G 2340/0435
See application file for complete search history.

(56) References Cited

U.S. PATENT DOCUMENTS

| | | | | |
|---|---|---|---|---|
| 5,748,169 | A | 5/1998 | Okumura et al. | |
| 7,443,372 | B2 | 10/2008 | Lee et al. | |
| 8,120,598 | B2 | 2/2012 | Shin et al. | |
| 2010/0097368 | A1 | 4/2010 | Hwang | |
| 2011/0122117 | A1 | 5/2011 | Lee et al. | |
| 2013/0038639 | A1 | 2/2013 | Han et al. | |
| 2014/0085356 | A1 * | 3/2014 | Tanaka | G09G 3/3696 345/691 |
| 2014/0210808 | A1 * | 7/2014 | Arasawa | G09G 3/3614 345/212 |
| 2015/0022512 | A1 * | 1/2015 | Ahn | G09G 3/3607 345/212 |
| 2015/0154925 | A1 * | 6/2015 | Koyama | G09G 3/3696 345/174 |

FOREIGN PATENT DOCUMENTS

| | | | |
|---|---|---|---|
| EP | 2557560 | A2 | 2/2013 |
| KR | 10-2006-0059010 | A | 6/2006 |
| KR | 10-2006-0081811 | A | 7/2006 |
| KR | 10-2007-0039759 | A | 4/2007 |
| KR | 10-2007-0066013 | A | 6/2007 |
| KR | 10-2007-0076302 | A | 7/2007 |
| KR | 10-2008-0035333 | A | 4/2008 |
| KR | 10-0848953 | B1 | 7/2008 |
| KR | 10-2012-0068425 | A | 6/2012 |
| KR | 10-2013-0027226 | A | 3/2013 |

* cited by examiner

*Primary Examiner* — Andrew Sasinowski
(74) *Attorney, Agent, or Firm* — Lee & Morse, P.C.

(57) ABSTRACT

A controller controls the driving frequency and voltages for a display device. If image data corresponds to a moving picture, the controller drives a data driver and a gate driver at a moving picture frequency. If image data corresponds to a still image, drives the data driver and the gate driver at a still image frequency lower frequency than the moving picture frequency. When the still image is to be displayed, the signal controller also controls leakage current of a thin film transistor of a pixel based on a representative value of the image data, such that positive leakage current applied for a positive data voltage is equal to negative leakage current applied for a negative data voltage.

38 Claims, 13 Drawing Sheets

DISPLAY DEVICE AND DRIVING METHOD THEREOF

CROSS-REFERENCE TO RELATED APPLICATION

Korean Patent Application No. 10-2013-0044345, filed on Apr. 22, 2013, and entitled: "Display Device and Driving Method Thereof," is incorporated by reference herein in its entirety.

BACKGROUND

1. Field

Embodiments herein relate to controlling a display device.

2. Description of the Related Art

A display device typically includes a display panel and a signal controller. The signal controller generates a control signal to drive the display panel, together with an image signal received from an external signal source.

When the display panel is to display a still image, the signal controller receives the same image data from a graphic processing device for every frame. As a result, power consumption is high. In an attempt to overcome this problem, one approach involves lowering the driving frequency of the display during a time when a still image is to be displayed. However, this approach causes flickering in the still image due to leakage current. Display quality is therefore deteriorated.

SUMMARY

In accordance with one embodiment, a display device includes a display panel including a plurality of pixels to display an image based on image data, each pixel comprising or coupled to a gate line, a data line, and a thin film transistor connected to the gate line and the data line; a data driver which is connected to the data line and which applies a positive data voltage and a negative data voltage; a gate driver which is connected to the gate line; and a signal controller which controls the data driver and the gate driver.

The signal controller drives the data driver and the gate driver at a moving picture frequency when the image data corresponds to a moving picture, and drives the data driver and the gate driver at a still image frequency lower than the moving picture frequency when the image data corresponds to a still image.

When the image data corresponds to the still image, the signal controller drives the data driver and gate driver so that leakage current of the thin film transistor corresponds to positive leakage current when a positive data voltage is applied, and negative leakage current when a negative data voltage is applied with respect to a representative value of the still image.

The representative value may be an average gray value of image data which is applied to all of the pixels for one frame and satisfies and equation discussed below. The representative value may be an average gray value of the image data which is applied to the pixel connected to the gate line for one frame and which satisfies an equation discussed below.

The representative value may also be an average value of values obtained by multiplying weight values and gray values, after assigning the weight values to the gray values. The weight values may include values which are symmetrical with respect to an intermediate gray value.

The gate driver sequentially applies the gate-on voltage to the gate line and applies one of the first gate-off voltage and the second gate-off voltage in a period where the gate-on voltage is not applied.

A gate-off voltage generator may generate the first gate-off voltage and the second gate-off voltage, wherein: the gate-off voltage generator is divided into a first part which generates the first gate-off voltage and a second part which generates the second gate-off voltage, the first part and the second part divides power source voltage using a resistor to generate the first gate-off voltage and the second gate-off voltage, and one of the first part and the second part which outputs a variable gate-off voltage comprises a digital variable resistor.

The display device as claimed in claim 6, wherein: the first gate-off voltage is applied to the gate line which is connected to the pixel to which the positive data voltage is applied, and the second gate-off voltage is applied to the gate line which is connected to the pixel to which the negative data voltage is applied.

The first gate-off voltage has a fixed voltage level, and the second gate-off voltage has a voltage level which is varied based on the representative value. Also, a positive voltage between the source and gate, which is a voltage difference between the first gate-off voltage and the common voltage, has a same value as a negative voltage between the source and the gate which is a voltage difference between the second gate-off voltage and the negative data voltage.

The positive voltage between the source and the gate and the negative voltage between the source and the gate may have substantially a same value even when the moving picture is displayed. Also, the gate line to which first gate-off voltage is applied is adjacent to the gate line to which the second gate-off voltage is applied. In a data storing period where the data voltage is not applied, the voltage which is applied to the data line is lowered based on a kick back voltage.

The common voltage is applied to the display panel, and the common voltage has a value which varies in accordance with the moving picture frequency and the still image frequency. Also, the gate driver may sequentially apply the gate-on voltage to the gate line and applies one of the first gate-off voltage and the second gate-off voltage in a period where the gate-on voltage is not applied.

Also, a gate-off voltage generator which generates the first gate-off voltage and the second gate-off voltage, wherein: the gate-off voltage generator divides a first part which generates the first gate-off voltage and a second part which generates the second gate-off voltage, the first part and the second part divide a power source voltage using a resistor to generate the first gate-off voltage and the second gate-off voltage, and one of the first part and the second part which outputs a variable gate-off voltage comprises a digital variable resistor.

Also, the first gate-off voltage is applied to the gate line which is connected to the pixel to which the positive data voltage is applied, and the second gate-off voltage is applied to the gate line which is connected to the pixel to which the negative data voltage is applied.

Also, the second gate-off voltage is applied to the gate line which is connected to the pixel to which the negative data voltage is applied, and the second gate-off voltage has a voltage level which varies based on the representative value. A positive voltage between the source and gate, corresponding to a voltage difference between the first gate-off voltage and the common voltage, has substantially a same value as a negative voltage between the source and the gate corresponding to a voltage difference between the second gate-off voltage and the negative data voltage. The positive voltage between the source and the gate and the negative voltage between the source and the gate may have substantially the same value even when the moving picture is displayed.

Also, the first gate-off voltage varies in accordance with the common voltage, which varies to constantly maintain the positive voltage between the source and the gate corresponding to a voltage difference between the first gate-off voltage and the common voltage. The positive voltage between the source and the gate at the moving picture frequency may be substantially equal to as the positive voltage between the source and the gate at the still image frequency.

The gate line to which first gate-off voltage is applied is adjacent to the gate line to which the second gate-off voltage is applied. In a data storing period where the data voltage is not applied, the voltage which is applied to the data line is lowered based on a kick back voltage.

In accordance with another embodiment, a driving method of a display device includes receiving input data; distinguishing whether the input data corresponds to a moving picture or a still image; and if the input data is a still image, controlling a display panel, a gate driver, and a data driver to display the still image at a still image frequency. If the input data is a moving picture, controlling the display panel, the gate driver, and the data driver to display the moving picture at a moving picture frequency.

When the still image is displayed, controlling the gate driver to sequentially apply a gate-on voltage to the gate line and to apply one of a first gate-off voltage and a second gate-off voltage in a period where the gate-on voltage is not applied, the first gate-off voltage is applied to the gate line which is connected to the pixel to which a positive data voltage is applied, the second gate-off voltage is applied to the gate line which is connected to the pixel to which a negative data voltage is applied, and the second gate-off voltage has a voltage level which varies based on a representative value of the input data.

Distinguishing whether the input data is the moving picture or the still image may be performed based on a panel self refresh signal. Also, the representative value may be an average gray value of the image data which is applied to all of the pixels for one frame and satisfies an equation discussed below. Also, the representative value may be an average gray value of the image data which is applied to the pixel connected to the gate line for one frame and satisfies the equation discussed below.

The representative value may also be an average value of values obtained by multiplying weight values and gray values, after assigning the weight values to the gray values. The weight values are symmetrical to each other with respect to an intermediate gray value.

Also, the first gate-off voltage has a fixed voltage level, and the second gate-off voltage has a voltage level which varies based on the representative value. A positive voltage between the source and gate corresponding to a voltage difference between the first gate-off voltage and the common voltage may have substantially a same value as a negative voltage between the source and the gate corresponding to the voltage difference between the second gate-off voltage and the negative data voltage.

Also, the positive voltage between the source and the gate and the negative voltage between the source and the gate may have substantially a same value even when the moving picture is displayed. The gate line to which first gate-off voltage is applied may be adjacent to the gate line to which the second gate-off voltage is applied.

Also, the method may include lowering a voltage applied to the data line based on a kick back voltage in the data storing period where the data voltage is not applied. The common voltage is applied to the display panel, and the common voltage has a value which varies in accordance with the moving picture frequency and the still image frequency.

Also, the first gate-off voltage varies in accordance with the common voltage, which varies so as to constantly maintain the positive voltage between the source and the gate corresponding to a voltage difference between the first gate-off voltage and the common voltage.

BRIEF DESCRIPTION OF THE DRAWINGS

Features will become apparent to those of ordinary skill in the art by describing in detail exemplary embodiments with reference to the attached drawings in which.

DETAILED DESCRIPTION

Figure 1:
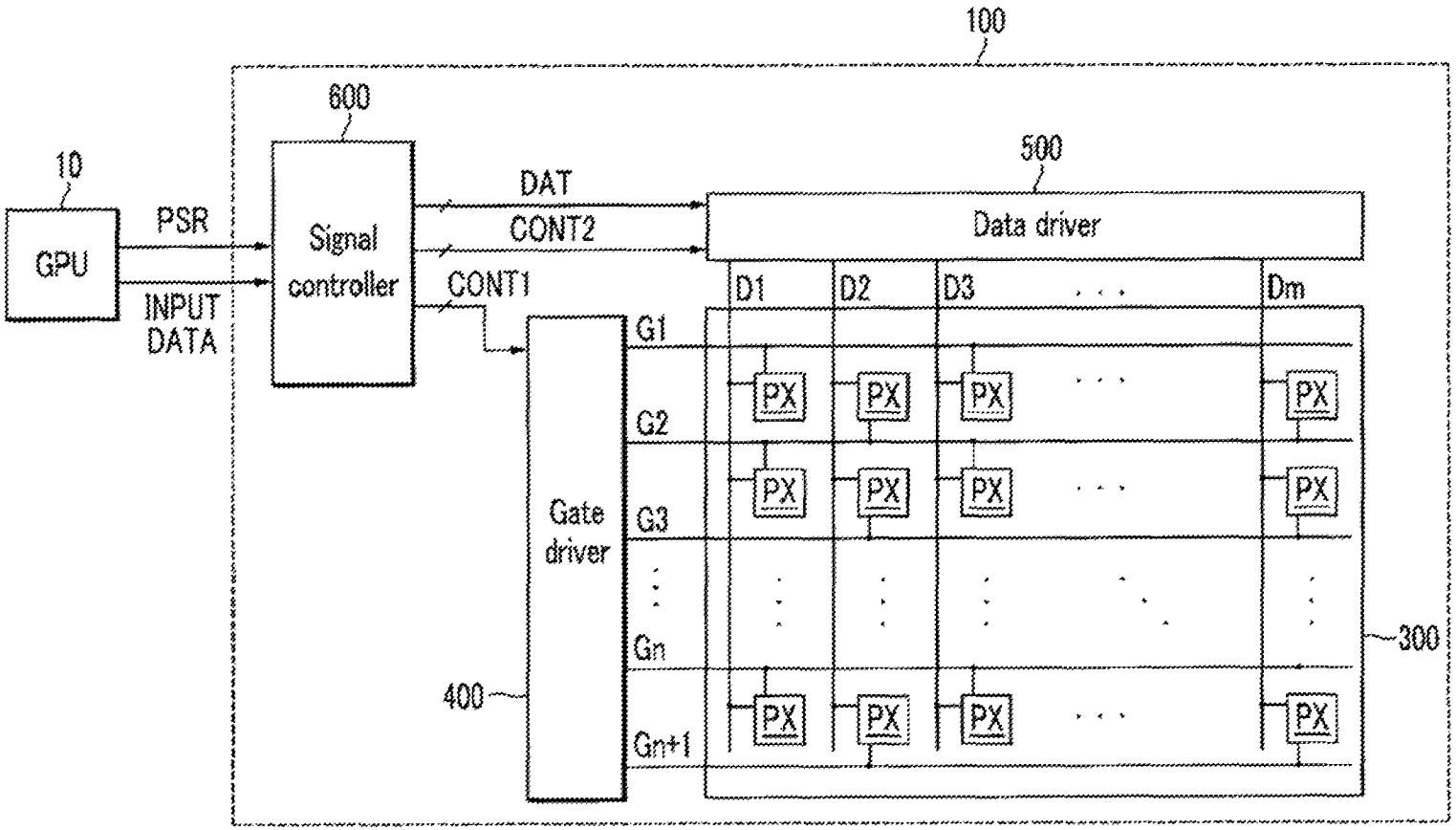
FIG. 1 illustrates one embodiment of a display device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of a display device 100 which includes a display panel 300 for displaying an image, a data driver 500, a gate driver 400 for driving the display panel 300, and a signal controller 600 for controlling the data driver 500 and the gate driver 400. Also, a graphic processing unit (GPU) 10 may be coupled to or located within the display device 100.

The graphic processing unit 10 provides input data, including data for an image to be displayed on the display device 100, and a panel self refresh (PSR) signal which is a distinguishing signal to distinguish whether the image is a still image or a moving picture. The display device 100 displays the image in accordance with the input data. If the image is indicated to be a still image based on the PSR signal, the display device 100 may display an image of a previous frame by itself.

The display panel 300 may be any one of a variety of digital, high-definition, or flat display panels or monitors. For illustrative purposes, the display panel is assumed to be a liquid crystal panel. Other examples of the display panel include but are not limited to an organic light emitting display panel, an electrophoresis display panel, and a plasma display panel.

The display panel 300 includes a plurality of gate lines (G1 to Gn+1 and a plurality of data lines D1 to Dm. The plurality of gate lines G1 to Gn+1 extends in a horizontal direction and the plurality of data lines D1 to Dm extends in a vertical direction so as to be insulated from and intersect with the plurality of gate lines G1 to Gn+1.

One of the gate lines G1 to Gn+1 and one of the data lines D1 to Dm are connected to one pixel PX. The pixels PX are arranged in a matrix and each of the pixels PX includes a thin film transistor, a liquid crystal capacitor and a storage capacitor.

A control terminal of the thin film transistor is connected to one of the gate lines G1 to Gn+1, an input terminal of the thin film transistor is connected to one of the data lines D1 to Dm, and an output terminal of the thin film transistor is connected to one of terminals (pixel electrode) of the liquid crystal capacitor and one of terminals of the storage capacitor. The other terminal of the liquid capacitor is connected to a common electrode and a storage voltage Vcst is applied to the other terminal of the storage capacitor. In some exemplary embodiments, a channel layer of the thin film transistor may be an amorphous silicon, a poly silicon, or oxide semiconductor.

One row of pixels PX may be connected alternately to a pair of gate lines, which may be disposed on and below the pixel. In other words, one of the gate lines G1 to Gn+1 is alternately connected to a pixel formed thereon and a pixel formed therebelow. With this structure, an odd numbered pixel and an even numbered pixel included in one row of the pixel may be connected to different gate lines from each other. In this case, each of the data lines D1 to Dm is connected to one or more a pixels which is disposed along one column.

The number of gate lines G1 to Gn+1 may be one larger than the number n of pixel columns. In one embodiment, no pixel row may be provided above the first gate line G1, as shown in FIG. 1, so that the gate lines are alternately connected only to the pixel row which is provided below the first gate line G1. Further, in at least one embodiment, no pixel row may be provided below the n+1-th gate line Gn+1 so that the gate lines are alternately connected only to the pixel row which are disposed above the gate line Gn+1.

The signal controller 600 performs so as to be suitable for an operation condition of the liquid crystal display panel 300 in response to the input data, the PSR signal, and one or more control signals input from an external signal source. The one or more control signals may include all or a portion of a vertical synchronization signal Vsync, a horizontal synchronization signal Hsync, a main clock signal MCLK, or a data enable signal DE. The signal controller 60 may output image data DAT, a gate control signal CONT1, a data control signal CONT2, and a clock signal based on the aforementioned signals.

The gate control signal CONT1 may include a scanning start signal STV which instructs to start outputting the gate-on voltage Von and a gate clock signal CPV which controls an output timing of the gate-on voltage Von.

The data control signal CONT2 may include a horizontal synchronization start signal STH which instructs to start inputting image data DAT and a load signal TP which applies a data voltage to the data lines D1 to Dm.

The signal controller 600 uses the gate control signal CONT1 and the data control signal CONT2 to allow the gate driver 400 and the data driver 500 to display the still image and the moving picture on the display panel 300 at a still image frequency and a moving picture frequency, respectively. If a plurality of consecutive frames has the same image data, the still image is displayed and if the plurality of consecutive frames has different image data, the moving picture is displayed. The signal controller 600 distinguishes whether to be the moving picture or the still image through the PSR signal.

The signal controller 600 displays the still image at a still image frequency, which may be lower than a moving picture frequency. The still image frequency may be some predetermined fraction of the moving picture frequency, e.g., ⅔ of the moving picture frequency or lower and, specifically, 1 Hz or higher in this example.

The plurality of gate lines G1 to Gn+1 of the display panel 300 is connected to the gate driver 400 and the gate-on voltage Von is sequentially applied to the gate driver 400 in accordance with a gate control signal CONT1 which is applied from the signal controller 600.

In a period where the gate-on voltage Von is not applied to the gate lines G1 to Gn+1, a gate-off voltage Voff may be applied. The gate-off voltage Voff may have at least two voltage levels. In one embodiment, a first gate-off voltage Voff1 may be applied to a pixel to which a positive data voltage is applied when the still image is displayed. A second gate-off voltage Voff2 may be applied to a pixel to which a negative data voltage is applied when the still image is displayed.

At least one of the first gate-off voltage Voff1 and the second gate-off voltage Voff2 may have a variable voltage level. In one embodiment, the first gate-off voltage Voff1 may have a fixed voltage level and the second gate-off voltage Voff2 may have a voltage level which varies depending on a value of the data voltage (e.g., representative value). Here, the representative value of the data voltage may be a representative value of the image data DAT.

In one embodiment, the first gate-off voltage Voff1 and the second gate-off voltage Voff2 are distinguishably applied when the still image is displayed, and only the first gate-off voltage Voff1 is applied when a moving picture is displayed. However, in other embodiments, the first gate-off voltage Voff1 and the second gate-off voltage Voff2 may be also distinguishably applied even when a moving picture is displayed.

The plurality of data lines D1 to Dm of the display panel 300 is connected to the data driver 500, and the data driver 500 receives the data control signal CONT2 and image data DAT from the signal controller 600. The data driver 500 converts the image data DAT into the data voltage using a gray voltage generated in a gray voltage generator. The converted data voltage is then transmitted to the data lines DL to Dm. The data voltage may have values which include a positive data voltage and a negative data voltage. The positive data voltage and the negative data voltage are alternately applied to be inversely driven with respect to the frame, the row or the column. Such inversion driving may be used to display a moving picture or a still image.

In the case of a still image displayed at the still image frequency, a voltage, which is charged once to the liquid crystal capacitor Clc of a pixel, is maintained for a relatively long period of time.

More specifically, when the still image is displayed, the image is displayed at the still image frequency. In this case, because the still image frequency is lower than the moving picture frequency, when the data voltage is applied once to the pixel, the data voltage is not applied for a relatively long time. Particularly, if the still image frequency is a low frequency (e.g., 10 Hz or lower), a time the data is applied (hereinafter, referred to as a data applying period) is very short and a time when the image is maintained with the applied data (hereinafter, referred to as a data storing period) is very long. In this case, there may be leakage current in the thin film transistor, which is a switching element connected to the liquid crystal capacitor Clc, so that the voltage charged in the liquid crystal capacitor Clc is lowered as time goes by. Further, in the case of a still image, the voltage is significantly lowered so to generate flickering.

Also, in the case of a moving picture, the voltage charged in the liquid crystal capacitor is lowered due to the leakage current. However, the moving picture frequency may be sufficiently high so that a subsequent data voltage is rapidly applied to the liquid crystal capacitor Clc. Therefore, the change in a luminance due to the leakage current may not be actually recognized.

In accordance with at least one embodiment, when a moving picture is displayed, only one of the first gate-off voltage Voff1 or the second gate-off voltage Voff2 (e.g., the first gate-off voltage Voff1) is used.

To summarize up to this point, if a moving picture is displayed based on the PSR signal received by the signal controller 600, the display panel 300 displays the moving picture at the moving picture frequency for one frame. In this case, the gate-on voltage is sequentially applied to each of gate lines G1 to Gn+1 and the gate-off voltage is applied in a period where the gate-on voltage is not applied to each of the gate lines G1 to Gn+1. The first gate-off voltage Voff1 is used as the gate-off voltage and the first gate-off voltage Voff1 may have a fixed level. In the meantime, a positive voltage and a negative voltage are alternately applied as the data voltage.

When a still image is displayed based on the PSR signal received by the signal controller 600, the display panel 300 displays the still image at the still image frequency, which is lower than the moving picture frequency for one frame. In this case, the gate-on voltage (which may have the same level as the moving picture is displayed) is sequentially applied to each of the gate lines G1 to Gn+1, and only one of the positive data voltage or the negative data voltage is applied to the plurality of pixels connected to one gate line.

The first gate-off voltage Voff1 is applied to the gate line which is connected to the pixel to which the positive data voltage is applied during the period where the gate-on voltage is not applied, and the second gate-off voltage Voff2 is applied to the gate line which is connected to the pixel to which the negative data voltage is applied during the period where the gate-on voltage is not applied.

The second gate-off voltage Voff2 may have different levels of voltage for every gate line. A voltage value of the second gate-off voltage Voff2 may be set such that a voltage between the gate electrode and the source electrode of the thin film transistor included in the pixel (hereinafter, referred to as a GS voltage Vgs) is equal to a voltage when the first gate-off voltage Voff1 and the positive data voltage are applied.

However, because the number of pixels connected to one gate line is large, a representative value of the image data (or the data voltage) which is applied to all pixels connected to the gate line is calculated and the second gate-off voltage Voff2 may be set based on the representative value. This will be described in greater detail with reference to FIG. 2 to FIG. 7.

In accordance with at least one embodiment, the data voltages having the same polarity are applied to a pixel connected to one gate line. Such a pixel arrangement structure may be various and the pixel arrangement of FIG. 1 will be described below.

In FIG. 1, one row of pixels PX is alternately connected to the pair of gate lines which are disposed thereabove and therebelow. Further, the gate lines G1 to Gn+1 are connected to the pixel disposed above the gate line and the pixel disposed therebelow.

In the embodiment of FIG. 1, there is no pixel row above the first gate line G1, so that the gate lines are alternately connected to only the pixel rows which are disposed therebelow. Further, the number of gate lines G1 to Gn+1 is one larger than the number n of the pixel rows. Also, in FIG. 1, the first gate line G1 is connected to a pixel disposed in an odd numbered pixel array of the first pixel row and the second gate line G2 is connected to an odd numbered pixel array of the second pixel row and an even numbered pixel array of the first pixel row. In this case, each of the data lines D1 to Dm is connected to the pixel disposed along the one line.

The connection structure in which an odd numbered pixel and an even numbered pixel in one pixel row are connected to different gate lines may have an advantage in that, even though the data voltage which is applied to the data line has the same polarity, the image is displayed in a similar way as the dot inversion in entire display panel 300.

Hereinafter, referring to FIG. 2 to FIG. 7, characteristics of two gate voltages Voff1 and Voff2 will be described.

FIG. 2 to FIG. 7 illustrate drawings illustrating a relationship between the polarity and the voltage in the display device according to one embodiment.

Figure 2:
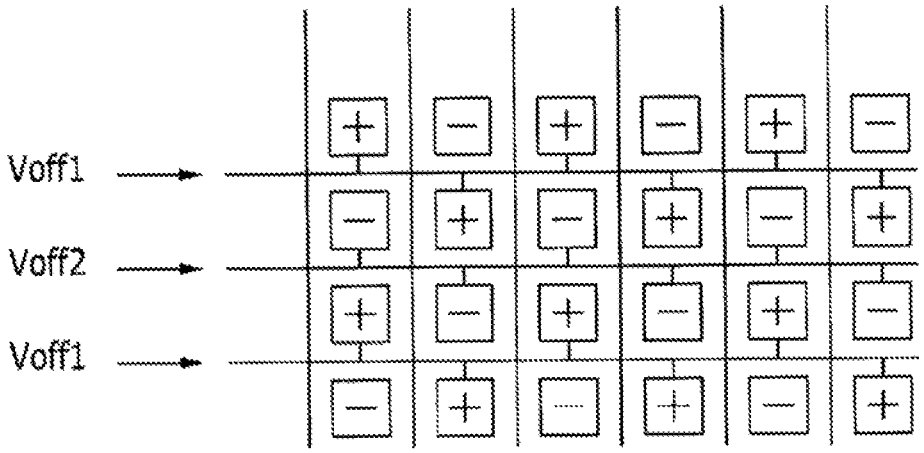
FIGS. 2 to 7 illustrate voltages with different polarities for a display device.

First, as shown in FIG. 2, when a still image is displayed, different gate-off voltages are applied to adjacent gate lines. That is, the first gate-off voltage Voff1 and the second gate-off voltage Voff2 are alternately applied. The first gate-off voltage Voff1 is applied to the gate line which is connected to the pixel to which the positive data voltage is applied during the period where the gate-on voltage is not applied and the second gate-off voltage Voff2 is applied to the gate line which is connected to the pixel to which the negative data voltage is applied during the period where the gate-on voltage is not applied. The gate-on voltages may have the same voltage value.

Figure 3:
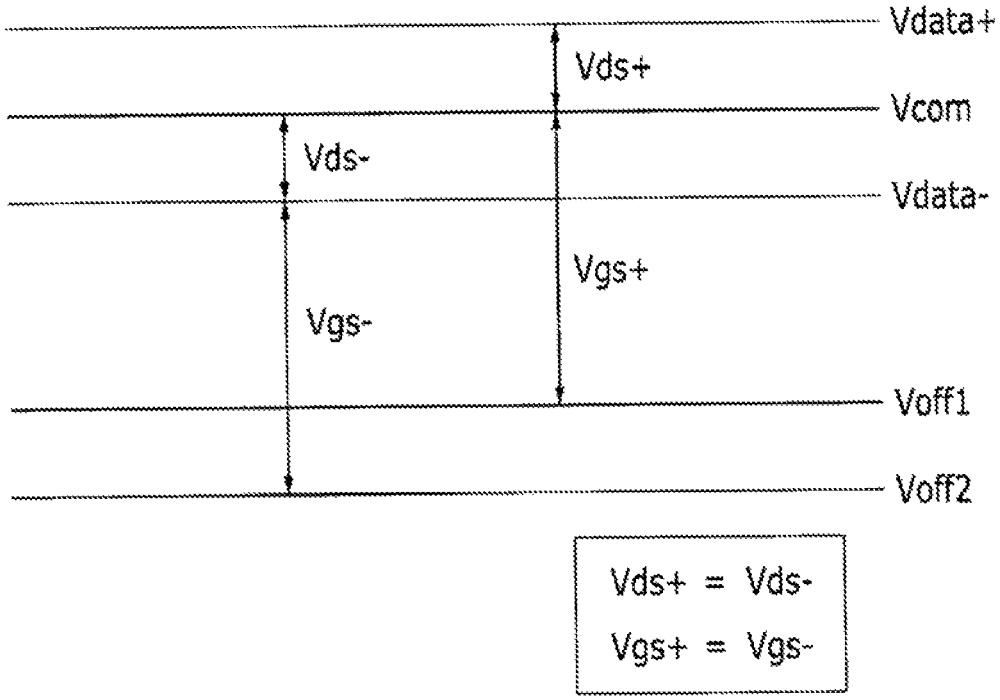

The first gate-off voltage Voff1 and the second gate-off voltage Voff2 have the characteristics shown in FIG. 3. In FIG. 3, a relationship between the first gate-off voltage Voff1 and the second gate-off Voff2 voltage when the positive data voltage Vdata+ and the negative data voltage Vdata− are applied to one pixel is shown.

A voltage difference between the positive data voltage Vdata+ and the common voltage Vcom may be the same as a voltage difference between the negative data voltage Vdata− and the common voltage Vcom. FIG. 3 shows the voltage difference between the positive data voltage Vdata+ and the common voltage Vcom as Vds+ and the voltage difference between the negative data voltage Vdata− and the common voltage Vcom as Vds−.

When the positive data voltage Vdata+ is applied, the first gate-off voltage Voff1 is applied. In this case, the voltage Vgs between a source and a gate of the thin film transistor is shown in FIG. 3 as Vgs+. When the negative data voltage Vdata− is applied, the second gate-off voltage Voff2 is applied so that the voltage Vgs between the source and the gate of the thin film transistor is shown in FIG. 3 as Vgs−.

The first gate-off voltage Voff1 and the second gate-off voltage Voff2 are set such that the voltage between the source and the gate of the thin film transistor when the positive data voltage is applied (Vgs+; referred to as a positive voltage between the source and gate) is the same as the voltage between the source and the gate of the thin film transistor when the negative data voltage is applied (Vgs−: referred to as a negative voltage between the source and gate). In one embodiment, the first gate-off voltage Voff1 is fixed at a constant level and the second gate-off voltage Voff2 is varied depending on a value of the image data (representative value).

In this case, referring to FIG. 3, the positive voltage Vgs+ between the source and gate is a voltage between the first gate off voltage Voff1 and the common voltage Vcom, and the negative voltage Vgs− between the source and the gate is a voltage between the second gate off voltage Voff2 and the negative data voltage Vdata−.

This is because the voltage Vgs between the source and the gate, when leakage current is considered, is a voltage value in the data storing period rather than the voltage value in the data applying period where the data voltage is applied.

Figure 4:
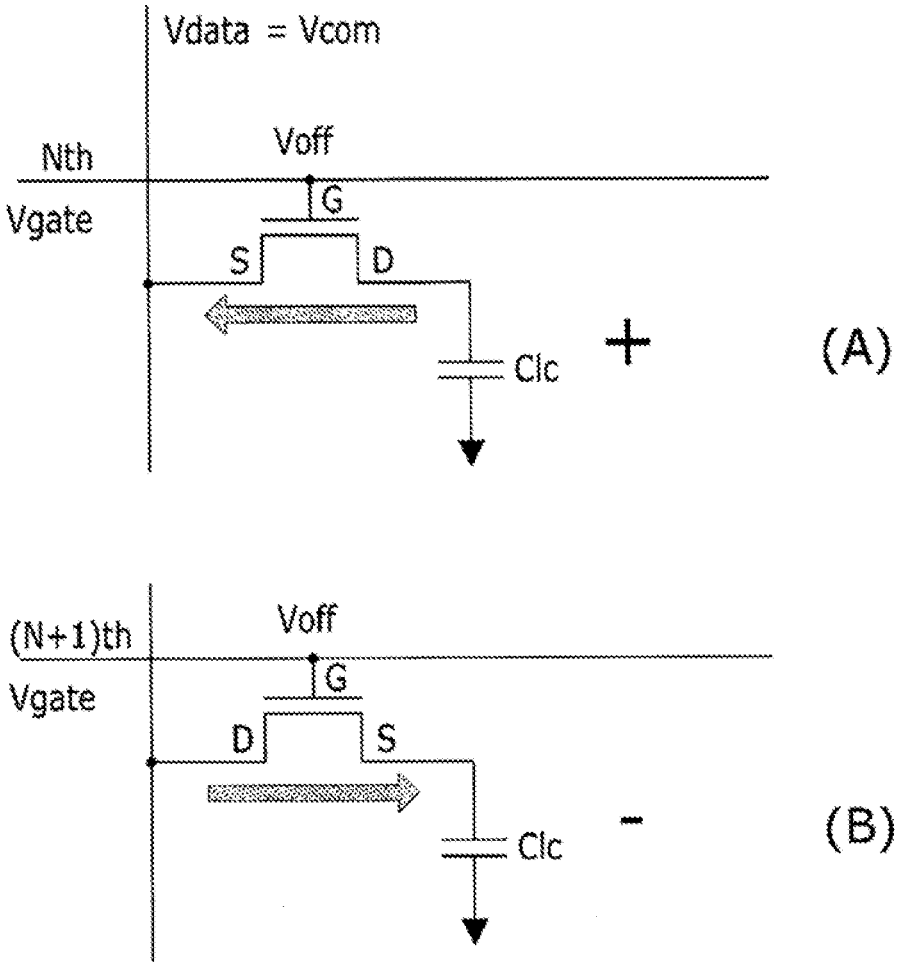

That is, FIG. 4 shows a characteristic of leakage current when a positive data voltage is applied and a characteristic of leakage current when a negative data voltage is applied. As shown in FIG. 4A, when the positive data voltage is applied, the positive voltage is applied to the liquid crystal capacitor Clc. As a result, the data line serves as a source of the thin film transistor. Further, the voltage Vdata which is applied to the data line in the data storing period has the common voltage Vcom value, and the voltage Vgate value which is applied to the gate line has the first gate off voltage Voff1. As a result, the voltage Vgs between the source and the gate in the thin film transistor is equal to a voltage between the first gate-off voltage Voff1 and the common voltage Vcom, as illustrated in FIG. 3.

As shown in FIG. 4B, when the negative data voltage is applied, the negative voltage is applied to the liquid crystal capacitor Clc so that the liquid crystal capacitor Clc serves as the source of the thin film transistor. Further, the voltage stored in the liquid crystal capacitor Clc is the negative data voltage Vdata−, and the value of the voltage Vgate which is applied to the gate line is the second gate-off voltage Voff2. As a result, the voltage Vgs between the source and the gate of the thin film transistor is equal to a voltage between the second gate-off voltage Voff2 and the negative data voltage Vdata−, as shown in FIG. 3.

In at least one embodiment, the first gate-off voltage Voff1 and the second gate-off voltage Voff2 are set such that the positive voltage Vgs+ between the source and the gate has the same value as the voltage Vgs− between the source and the gate. The first gate-off voltage Voff1 uses a generally-used gate-off voltage value and the value of the second gate-off voltage Voff2 is adjusted based on the value (representative value) of the image data. As a result, the two voltages Vgs between the source and the gate may match with each other.

Figure 5:
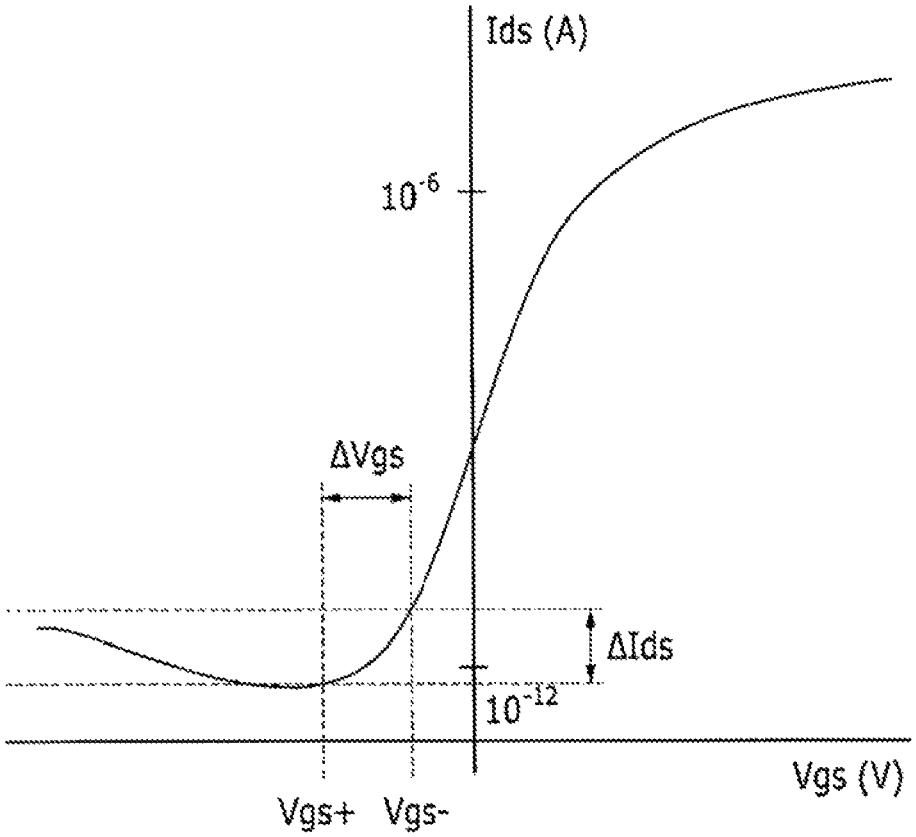

A relationship between the two voltages Vgs between the source and the gate and leakage current Ids is shown in FIG. 5. In the graph of FIG. 5, the horizontal axis represents the voltages Vgs between the source and the gate and the vertical axis represents the leakage current Ids. The graph shows a result which is measured with respect to one thin film transistor.

As shown in the graph of FIG. 5, different leakage currents ids are generated depending on the voltage Vgs between the source and the gate. In this case, if the voltage Vgs+ between the source and the gate when the positive data voltage is applied is different from the voltage Vgs− between the source and the gate when the negative data voltage is applied, leakage currents are also different from each other. As a result, the degree to which the display luminance is changed varies.

When a moving picture is displayed, a new data voltage is applied to the pixel at a sufficiently high frequency so that the leakage current is not so large, which may be ignored. In contrast, when a still image is displayed, the pixel is driven at a low frequency. As a result, a relatively long time is required to pass until a new data voltage is applied to the pixel, which may cause flickering to be perceived by a user.

From FIG. 5, it is understood that, if the positive voltage Vgs+ between the source and the gate is different from the negative voltage Vgs− between the source and the gate, the amount of leakage current may also vary.

Figure 6:
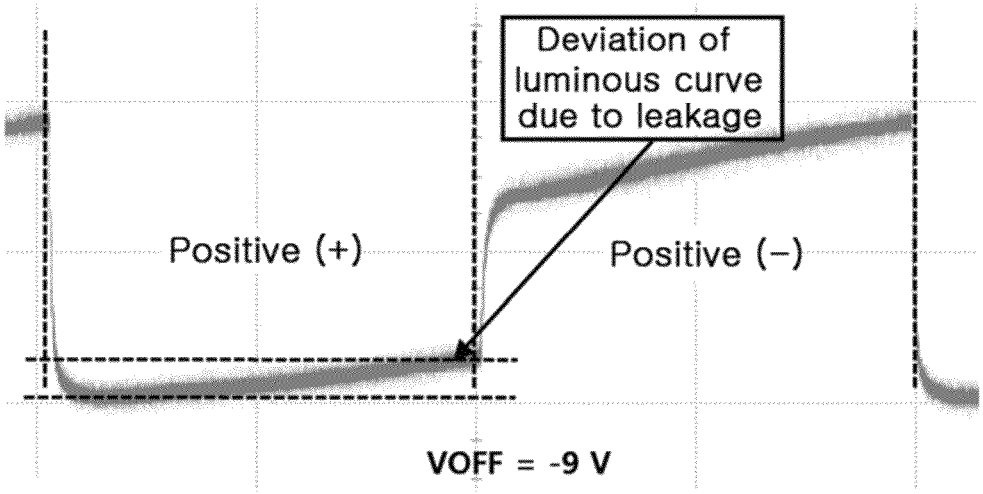
Figure 7:
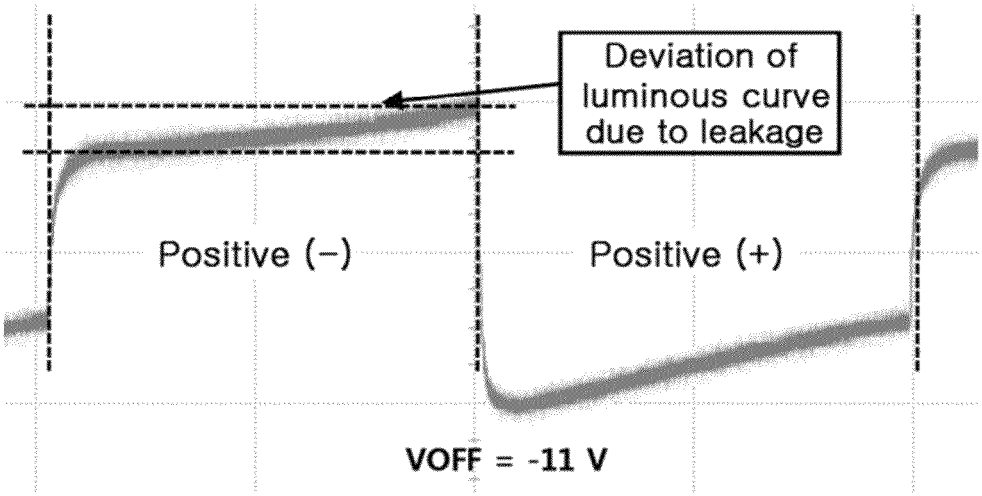

FIG. 6 and FIG. 7 illustrate the change of the voltage which is charged in the liquid crystal capacitor Clc. In FIG. 6, the gate-off voltage is −9 V and in FIG. 7, the gate-off voltage Voff is −11 V. FIG. 6 and FIG. 7 show a test result which is performed in the display device according to the embodiment of FIG. 1 at a low frequency, that is, 1 Hz.

In FIG. 6, it is understood that leakage current is low when the positive data voltage (positive polarity) is applied, but that leakage current is high when the negative data voltage (negative polarity) is applied. Further, in FIG. 7, it is understood that leakage current is high when the positive data voltage (positive polarity) is applied, but that leakage current is low when the negative data voltage (negative polarity) is applied.

Therefore, the gate-off voltage Voff of FIG. 6 is set to the first gate-off voltage Voff1 and the gate-off voltage Voff of FIG. 7 is set to the second gate-off voltage Voff2. As a result, in all cases when the positive data voltage and the negative data voltage are generated, the leakage current is low.

That is, when FIG. 6 and FIG. 7 are considered, the first gate-off voltage Voff1 and the second gate-off voltage Voff2 may be set such that the value of the leakage current is small for each of the polarities. In the exemplary embodiment shown in FIG. 6 and FIG. 7, the representative value of the image data is not considered, but the first gate-off voltage Voff1 and the second gate-off voltage Voff2 value are set by the experiment such that the value of the leakage current is equal to or lower than a predetermined level.

That is, the first gate-off voltage Voff1 and the second gate-off voltage Voff2 are set such that the positive voltage Vgs between the source and the gate and the negative voltage are same or have a difference negligible by the user, or the value of the leakage current for each of the polarities is below a predetermined level (for example, 10% or less).

Actually, a plurality of pixels is connected to the gate line so that it is difficult to perfectly match the positive voltage Vgs between the source and the gate with the negative voltage Vgs− between the source and the gate. Thus, the voltages may be set such that a user cannot generally recognize the difference therebetween.

An exemplary embodiment will be described with reference to FIG. 8, in which a representative value of a data voltage (or image data) applied to a plurality of pixels connected to a gate line is calculated and a second gate-off voltage Voff2 is set using the representative value so that the display quality is not deteriorated even when operating at the still image frequency.

Figure 8:
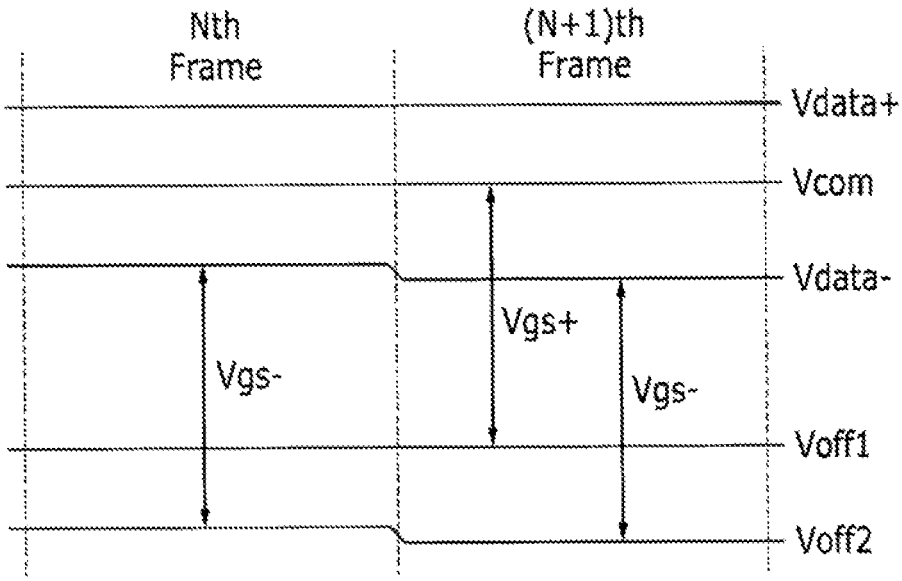
FIG. 8 illustrates additional voltages for a display device.

FIG. 8 illustrates a graph showing one embodiment of a voltage applied to the display device. First, a representative value of data voltages which are applied to the plurality of pixels connected to one gate line for one frame is calculated.

The representative value may have any one of a variety of values. For example, an intermediate gray value, an average value, or a value calculated using a weight value may be used as the representative value.

Examples of intermediate gray values which may be used as the representative value include an intermediate gray value of the image data applied for all of the pixels for one frame, an intermediate gray value of data which is applied to the pixel connected to the corresponding gate line for one frame, or an intermediate gray between black and white (for example, 32 gray scale values in total 64 gray scale values). In one embodiment, the second gate-off voltage Voff2 may be fixed so that signal processing is simple. In this case, flickering compensation may be performed, but it may be more difficult to do so.

Examples of average values which may be used as the representative value include an average gray value of the data applied to the entire pixels for one frame or an average gray value of the data which is applied to the pixel connected to the corresponding gate line for one frame may be used.

First, an average value of the image data which is applied to all of the pixels for one frame is used. In one embodiment, the average value is used as the representative value for the entire pixels, so that the second gate-off voltage Voff2 is fixed for every frame. That is, the second gate-off voltage Voff2 is sufficiently calculated for every frame.

The representative value may be an average of the characteristics of the entire screen so that the representative value is different from a characteristic for every row. Therefore, the flickering may be recognized due to the difference between the characteristic of the entire screen and the characteristic of the pixel of the corresponding row to which an actual gate-off voltage is applied.

An average value of the image data which is applied to the pixel connected to one gate line for one frame may be used. In this case, there is a drawback in that a data processing capacity for calculating the second gate off voltage Voff2 for every line, and a deviation may occur for every line, but the pixel characteristic of each of the pixels row is reflected so that a possibility of recognizing the flickering is very low.

Finally, when the representative value is calculated, a weight value may be applied and calculated. The value which is calculated using the weight value may be an average value of values obtained by multiplying weight value provided for every gray and the gray and calculated by the following Equation 1.

$$\text{Average gray value} = \frac{\sum_{GrayLevel=1}^{256}\left(\begin{array}{c}\text{weight value per gray}\times\\ GrayLevel\times\text{number of pixels}\end{array}\right)}{\sum_{GrayLevel=1}^{256}\left(\begin{array}{c}\text{weight value per gray}\times\\ \text{number of pixels}\end{array}\right)} \quad \text{Equation 1}$$

In Equation 1, the gray average value refers to the representative value calculated using the weight value and the weight value per gray refers to a weight value which is provided for every gray and a value of a rate of change in the graph of a gray (or transmittance) with respect to the voltage of the panel. In the graph of the gray (or transmittance) with respect to the voltage, the rate of change in the intermediate gray is the largest and thus the weight value is correspondingly the largest.

Further, the weight value may be a value which is symmetrical to both sides with respect to the intermediate gray. In Equation 1, as an example, 256 grays are used but other gray may be also used.

An example of the weight value is represented in the following Table 1.

TABLE 1

| | Gray value | | | | | | |
|---|---|---|---|---|---|---|---|
| | 1 | 2 | ... | 128 | ... | 255 | 256 |
| weight value | 0.45 | 0.55 | ... | 2 | ... | 0.5 | 0.45 |

In the case of the weight value of Table 1, a high gray value and a low gray value are symmetric to each other with respect to the intermediate gray value. In some embodiments, a difference between the weight values of adjacent gray values may be increased toward the intermediate gray value. That is, the difference in the weight values between one pair of gray values may only be 0.05 in the case of gray values 255 and 256, or 0.10 in the case of gray values 1 and 2, but the difference is increased as gray values move closer to the 128 gray value, which is the intermediate gray value.

The above described weight value may be understood to be a weight value in which a variation of light depending on the gray which is recognized by a human is considered, so that the representative value including the weight value also includes characteristics in accordance with a cognitive recognition by a human. As a result, the characteristic of recognizing the flickering may be lowered.

In the above description, various exemplary embodiments which set the representative value have been described. Each exemplary embodiment has not only a merit but also a drawback. In other words, if an exemplary embodiment has a drawback based on the characteristic of the display device, one of the two exemplary embodiments may be applied. Further, as a method of determining the representative value, various methods other than the method which has been described above may be also used.

If the representative value of the image data is determined by one method of the various exemplary embodiments, the gate line sets the second gate-off voltage Voff2 such that the voltages Vgs between the source and the gate of the thin film transistor are constant when the positive data voltage and the negative data voltage are applied to the representative value and displays the still image using the second gate-off voltage Voff2. The second gate-off voltage Voff2 may be varied for every gate line or for every frame.

FIG. 8 shows that the second gate-off voltage Voff2 is varied in different frames. As shown in FIG. 8, in the exemplary embodiment, the first gate-off voltage Voff1 is fixed by using a generally-used gate-off voltage and the common voltage Vcom also has a constant value so that the positive voltage Vgs+ between the source and the gate also has the same value for every frame.

In contrast, the negative voltage Vgs− between the source and the gate is a voltage between the second gate-off voltage Voff2 and the negative data voltage Vdata− so that the negative voltage Vgs− may have a value which is varied for every frame or every row.

The negative data voltage Vdata− illustrated in FIG. 8 represents a representative value of the image data for one frame. As the negative data voltage Vdata− changes depending on the representative value of the image data, the second gate-off voltage Voff2 also changes to set and drive the panel so as to constantly maintain the positive and negative voltages Vgs between the source and the gate.

The positive data voltage Vdata+ of FIG. 8 also represents a representative value of image data for one frame. This representative value may be varied in accordance with the frame. But, it is shown that, in one embodiment, the representative value is not varied regardless with the positive voltage between the source and the gate.

In some exemplary embodiments, the connection relationship of the gate line and the pixel may be different from the connection relationship of FIG. 1. An example thereof is shown in FIG. 9.

Figure 9:
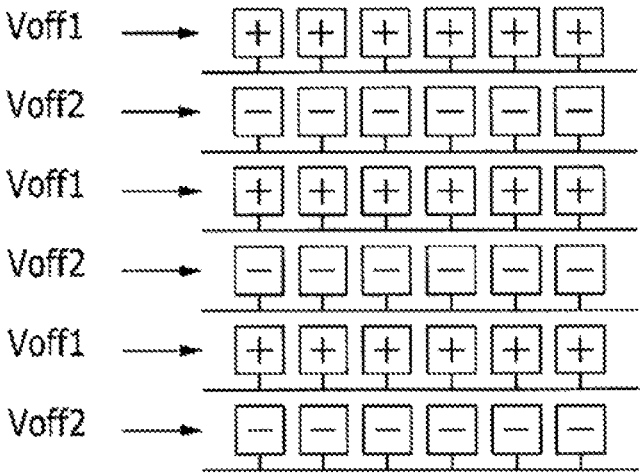
FIG. 9 illustrates a connection relationship between a gate line and a pixel.

FIG. 9 illustrates an embodiment of a connection relationship between a gate line and a pixel. In FIG. 9, differently from FIG. 1, one gate line is connected to one row of pixels. A data voltage which has the same polarity is applied to the one row of pixels connected to one gate line so that the data voltage is applied in a row inversion method as illustrated in FIG. 9. In this case, the first gate-off voltage Voff1 is applied to the gate line connected to the pixel to which the positive data voltage is applied. Further, the second gate-off voltage Voff2 is applied to the gate line connected to the pixel to which the negative data voltage is applied. In the structure of FIG. 9, the number of pixel rows may be equal to the number of gate lines.

Figure 10:
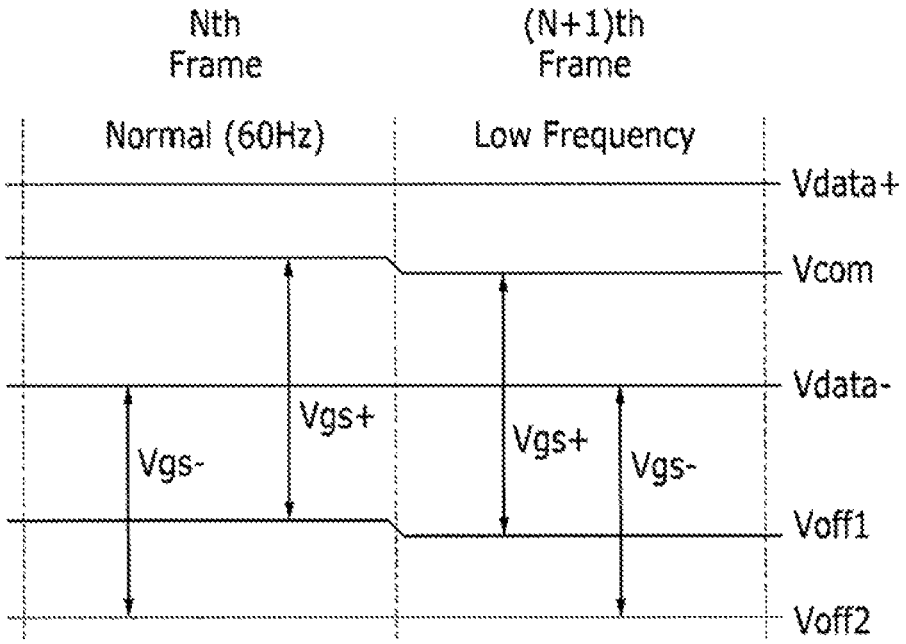
FIG. 10 illustrates a relationship between a driving frequency and voltage.

FIG. 10 illustrates a case where the common voltage Vcom varies depending on the frequency (moving picture frequency or the still image frequency) will be described.

Referring to FIG. 10, a relationship is illustrated between a driving frequency and a voltage in a display device according to one embodiment, and more specifically a timing chart is shown when the display drives at the moving picture frequency (normal (60 Hz) in N-th frame and drives at the still image frequency (shown as low frequency) from an N+1 th frame. This embodiment is characterized in that the common voltage Vcom of the display device varies depending on the driving frequency and the common voltage is reduced at the still image frequency more than that of the moving picture frequency.

However, when the common voltage Vcom varies, the first gate-off voltage Voff1 also varies so as to change the positive voltage Vgs+ between the source and the gate. As a result, even when the still image is displayed at the still image frequency, the negative voltage Vgs− between the source and the gate and the positive voltage Vgs− between the source and the gate are constantly maintained.

Also, in the exemplary embodiment of FIG. 10, the voltage Vgs between the source and the gate at the moving picture frequency is set to be equal to the voltage between the source and the gate at the still image frequency. At the moving picture frequency, the data voltage is frequently applied so that deterioration of the display quality due to the leakage current may not be recognized by the user. Nevertheless, when displaying at the moving picture frequency, the positive voltage may be matched with the negative voltages.

Also, as shown in FIG. 10, when the common voltage Vcom varies, the value of the first gate-off voltage Voff1 is varied. In the meantime, the second gate-off voltage Voff2 may be varied depending on the representative value as illustrated in FIG. 10. A structure of a gate-off voltage generator which changes the gate-off voltage Voff according to the exemplary embodiment of the present invention is shown in FIG. 11.

Figure 11:
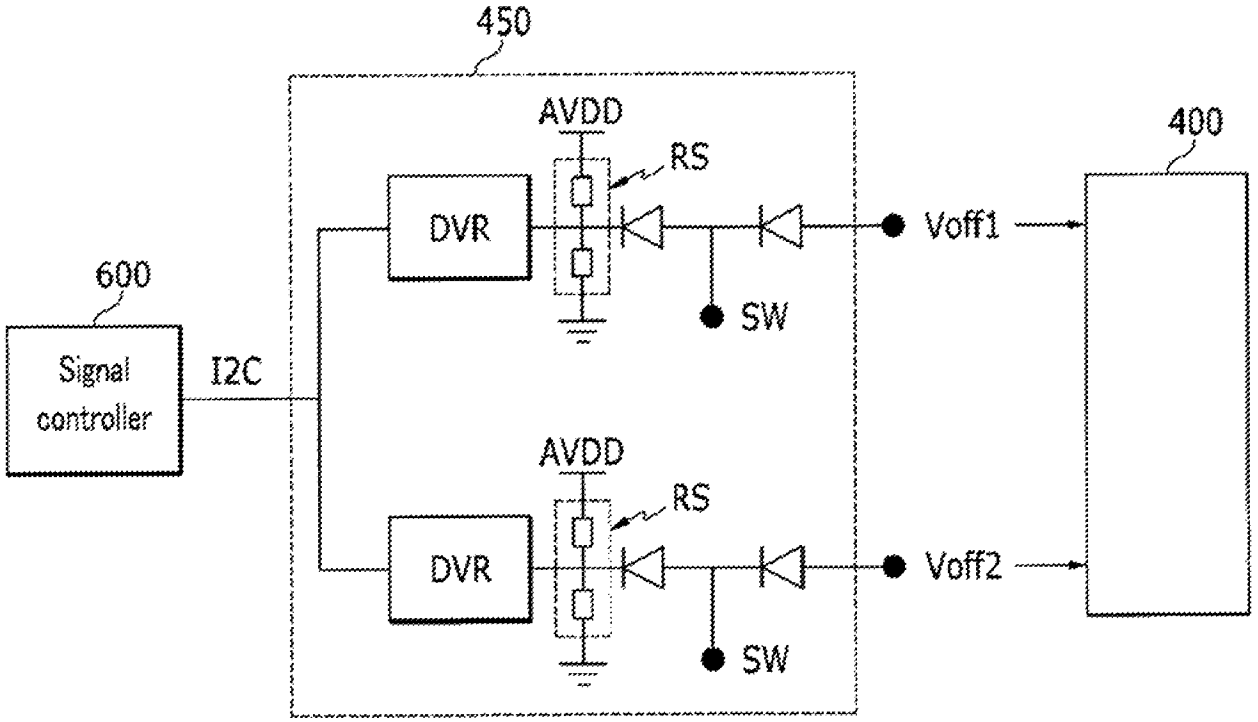
FIG. 11 illustrates an embodiment of a voltage generator for a display device.

FIG. 11 illustrates a circuit diagram of the gate-off voltage generator in the display device according to one embodiment. In this circuit diagram, a structure is shown in which the gate-off voltage Voff is varied using a variable resistor in accordance with the control of the signal controller 600.

The gate voltage generator 450 generates a gate-on voltage and a gate-off voltage in accordance with the control of the signal controller 600. The gate voltage generator 450 according to one embodiment generates one gate-on voltage and two gate-off voltages. A voltage level of at least one of gate-off voltages varies for every gate line so that the gate-off voltages have different voltage levels.

In one embodiment, the gate voltage generator 450 and the signal controller 600 may be connected in accordance with I2C communication standard and may be applied with the control signals by the I2C communication standard to generate the gate-on voltage and two gate-off voltages Voff1 and Voff2 in accordance with the control signal. The signal controller 600 considers the voltage value of the common voltage Vcom or a representative value of the image data in order to change at least one of the two gate-off voltages Voff1 and Voff2, and correspondingly changes the voltage.

A structure in which the gate voltage generator 450 generates two gate-off voltages Voff1 and Voff2 are shown in detail in FIG. 11.

The voltage level of the gate-off voltage is determined by dividing the voltage level of the power source voltage AVDD by a resistor. That is, the resistors are divided by a digital variable resistor (DVR) and resistor string RS from one end and the power source voltage AVDD is divided by the voltage which passes through the divided resistors. The divided power source voltage AVDD passes through the pair of diodes and is output from the gate voltage generator 450 to be transmitted to the gate driver 400.

Here, the value of the digital variable resistor DVR, that is, the resistance is varied in accordance with the control of the signal controller 600 and thus the gate-off voltage to be output is changed to be output. The value of the digital variable resistor DVR may be stored in a lookup table LUT which is disposed inside or outside of the signal controller 600. That is, the voltage value of the common voltage Vcom or the representative value of the image data is considered and thus the value of the digital variable resistor DVR is selectively applied from the lookup table LUT.

In FIG. 11, the digital variable resistor DVR is included in all routes where the first gate-off voltage Voff1 and the second gate-off voltage Voff2 are generated and thus the levels of both the two gate-off voltages may be changeable. In some embodiments, if only one gate off voltage is changed, the digital variable resistor DVR may not be included at the gate-off voltage side which is not changed. Further, each gate-off voltage is adjusted by the switch SW signal so that the gate-off voltage is output or not. The switch SW signal may be applied in accordance with the control of the signal controller 600.

Hereinafter, a detailed structure in which two gate-off voltages which are applied to the gate driver 400 is applied to the gate line will be described with reference to FIG. 12.

Figure 12:
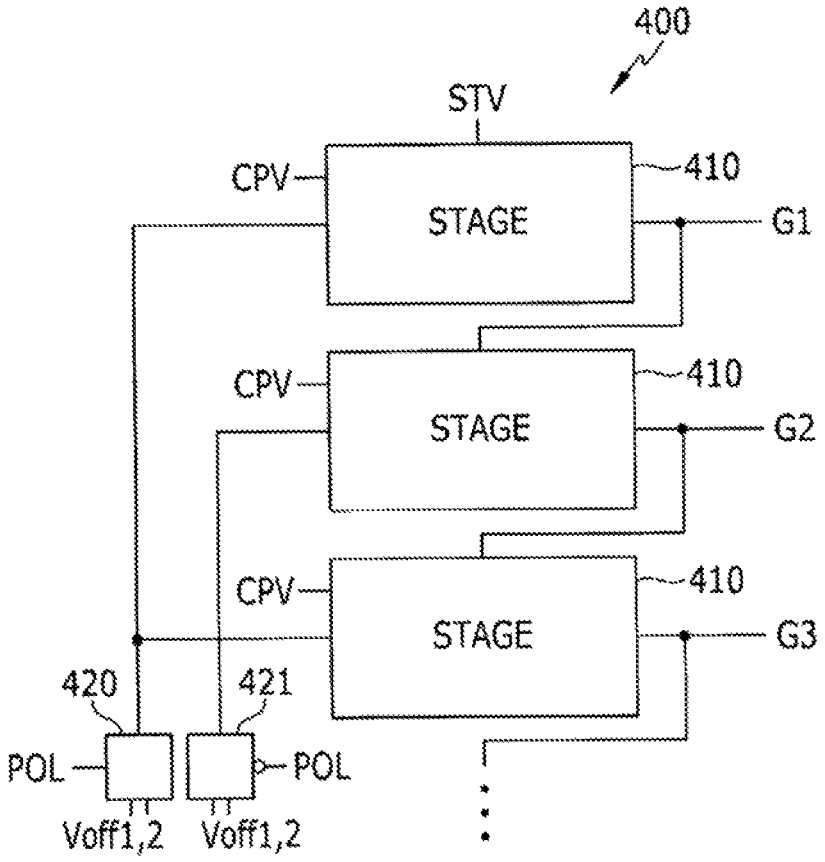
FIG. 12 illustrates an embodiment of a gate driver for a display device.

FIG. 12 illustrates a circuit diagram of the gate driver in the display device according to an exemplary embodiment. The first gate-off voltage Voff1 and the second gate-off voltage Voff2 which are applied from the gate voltage generator 450 are input to a pair of input terminals 420 and 421 of the gate driver 400. Here, at least one of the first gate-off voltage Voff1 and the second gate-off voltage Voff2 may have a voltage value which is changed for every frame or for every row.

The input terminals 420 and 421 are applied with a polarity signal POL and the input terminals 420 and 421 output one of the first gate-off voltage Voff1 and the second gate-off voltage Voff2 in accordance with the polarity signal POL. Here, the input terminals 420 and 421 are formed of multiplexers. Also, the polarity signal POL may be a signal which is changed for every frame and indicates a polarity of the data voltage of the first pixel or pixel row.

In this embodiment, if the polarity signal POL is positive, the first input terminal 420 outputs the first gate-off voltage Voff1 and if the polarity signal POL is negative, outputs the second gate-off voltage Voff2. Further, if the polarity signal POL is negative, the second input terminal 421 outputs the first gate-off voltage Voff1 and if the polarity signal POL is positive, outputs the second gate-off voltage Voff2.

Accordingly, if the polarity signal POL is positive, the first gate line is applied with the first gate-off voltage Voff1 and the second gate line is applied with the second gate-off voltage Voff2.

As a result, the first gate-off voltage Voff1 is applied to the gate line which is connected to the pixel to which the positive data voltage is applied in a period where the gate-on voltage is not applied and the second gate-off voltage Voff2 is applied to the gate line which is connected to the pixel to which the negative data voltage is applied in a period where the gate-on voltage is not applied.

The gate driver 400 may include a plurality of stages 410 and each of the stages 410 sequentially outputs the gate-on voltage to each of the gate lines in accordance with the clock signal CPV and the start synchronization signal STV or a gate-on voltage of a previous gate line. In a period where the gate-on voltage is not output, the first gate-off voltage Voff1 and the second gate-off voltage Voff2 are alternately applied.

As described above, when the display device is driven at the still image frequency which is the low frequency, in order to constantly maintain leakage current of the thin film transistor (which is the switching element included in the pixel), the first gate-off voltage Voff1 is applied to the gate line, which is connected to the pixel to which the positive data voltage is applied in a period where the gate-on voltage is not applied and the second gate-off voltage Voff2 is applied to the gate line which is connected to the pixel to which the negative data voltage is applied in a period where the gate-on voltage is not applied.

When the display device is driven at the moving picture frequency, the first gate-off voltage Voff1 is applied to the gate line which is connected to the pixel to which the positive data voltage is applied in a period where the gate-on voltage is not applied and the second gate-off voltage Voff2 is applied to the gate line which is connected to the pixel to which the negative data voltage is applied in a period where the gate-on voltage is not applied.

Hereinafter, in order to constantly maintain leakage current of the thin film transistor which is the switching element included in the pixel, a voltage Vds between the source and the drain of the thin film transistor when the positive data voltage is applied is equal to the voltage Vds when the negative voltage is applied. Such an exemplary embodiment will be described with reference to FIG. 13.

Figure 13:
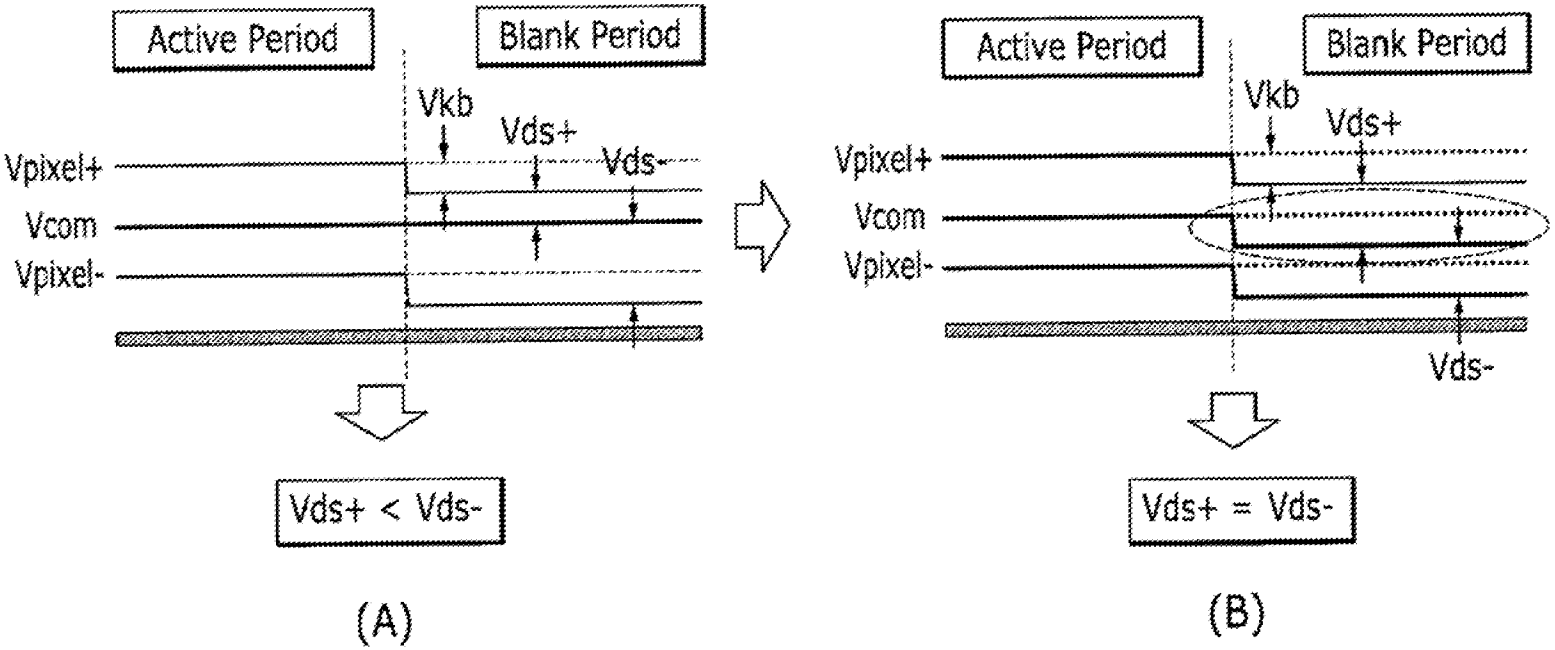
FIG. 13 illustrates an embodiment of a waveform diagram illustrating when a data voltage may be varied in a display device.

FIG. 13 illustrates a waveform diagram when a data voltage is varied in the display device according to an exemplary embodiment. An amplitude of the leakage current may be varied by the difference between the voltage at the source of the thin film transistor, which is a switching element included in the pixel, and the voltage at the drain thereof. If the voltage Vds between the source and the drain when the positive data voltage is applied is different from the voltage Vds between the source and the drain, the amplitude of the leakage current is varied.

Thus, flickering may not be recognized due to the leakage current when the moving picture is displayed at the moving picture frequency. But, when the still image is displayed at the moving picture frequency which is the low frequency, the flickering may be recognized. A case when the flickering is recognized at the still image frequency will now be described with reference to FIG. 13A.

FIG. 13A shows change of an amplitude of the voltage charged in the pixel which is connected to one data line. Cases when the positive data voltage or the negative data voltage is applied when the same gray is displayed are shown above and below the common voltage Vcom. Here. Vpixel+ denotes a voltage of the pixel electrode to which the positive data voltage is charged and Vpixel− denotes a voltage of the pixel electrode to which the negative data voltage is charged.

Referring to FIG. 13A, the positive voltage Vds+ between the source and the drain of the thin film transistor is different from the negative voltage Vds− between the source and the drain of the thin film transistor. Therefore, if an active period (data applying period) where the data voltage is applied to the pixel ends, the gate-on voltage drops to the gate-off voltage (the first or the second gate-off voltage) and thus the voltage which is charged in the pixel electrode also drops. The voltage which drops as described above is referred to as a kick back voltage. In this case, the data line floats in a maintaining period where the data voltage is not applied or has the same voltage level as the common voltage Vcom. The pixel electrode charged with the positive data voltage drops in the lower direction and the pixel electrode charged with the negative voltage also drops in the low direction.

Therefore, as illustrated in FIG. 13A, the difference between the data line (which has the voltage level of the common voltage) to which voltage is not applied and the pixel electrode (a voltage Vds between the source and the drain of the thin film transistor) may have a significant difference in accordance with the polarity. As a result, the amplitude of the leakage current is varied and may be recognized as flickering by the user when the image is displayed at the still image frequency, which is the low frequency.

Therefore, in one embodiment as shown in FIG. 13B, in a blank period (data storing period) where the data voltage is not applied to the data line, the voltage of the data line is lowered by the kick back voltage from the common voltage Vcom so that the positive voltage Vds+ between the source and the drain of the thin film transistor at the positive polarity is equal to the negative voltage Vds− between the source and the drain of the thin film transistor. As a result, the leakage current at both polarities is same, which is not recognized as flickering.

The exemplary embodiment of FIG. 13 may be applied together with the exemplary embodiments of FIG. 1 to FIG. 3 and FIG. 8 to FIG. 12.

That is, as in the exemplary embodiment of FIG. 13, in the blank period where the data voltage is not applied to the data line, the voltage of the data line is lowered from the common voltage Vcom by a kick back voltage. Further, as in the exemplary embodiment of FIG. 3, FIG. 8 and FIG. 10, the first gate-off voltage Voff1 is applied to the gate line which is connected to the pixel to which the positive data voltage is applied in the period where the gate-on voltage is not applied and the second gate-off voltage Voff2 is applied to the gate line which is connected to the pixel to which the negative data voltage is applied in the period where the gate-on voltage is not applied.

By way of summation and review, according to one or more embodiments, by controlling the leakage current of a thin film transistor of a pixel, performance of the display device may be improved. In particular, a display device may be provided which prevents flickering from being recognized and thus reduces power consumption without deteriorating a display quality.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device, comprising:

a display panel including a plurality of pixels to display an image based on image data, each pixel including or coupled to a gate line, a data line, and a thin film transistor connected to the gate line and the data line;

a data driver connected to the data line and which applies a positive data voltage and a negative data voltage;

a gate driver connected to the gate line; and a signal controller which controls the data driver and the gate driver, wherein the signal controller drives the data driver and the gate driver at a moving picture frequency when the image data corresponds to a moving picture and drives the data driver and the gate driver at a still image frequency lower than the moving picture frequency when the image data corresponds to a still image, and wherein, when the image data corresponds to the still image, the signal controller drives the data driver and gate driver so that leakage current of the thin film transistor corresponds to positive leakage current when a positive data voltage is applied, and negative leakage current when a negative data voltage is applied with respect to a representative value of the still image.

2. The display device as claimed in claim 1, wherein:

the representative value is an average gray value of image data which is applied to all of the pixels for one frame and which satisfies the following equation:

$$\text{Average gray value} = \frac{\sum_{GrayLevel=1}^{256} \left( \begin{array}{c} \text{weight value per gray} \times \\ GrayLevel \times \text{number of pixels} \end{array} \right)}{\sum_{GrayLevel=1}^{256} \left( \begin{array}{c} \text{weight value per gray} \times \\ \text{number of pixels} \end{array} \right)}$$

3. The display device as claimed in claim 1, wherein:

the representative value is an average gray value of the image data which is applied to the pixel connected to the gate line for one frame and which satisfies the following equation:

$$\text{Average gray value} = \frac{\sum_{GrayLevel=1}^{256} \left( \begin{array}{c} \text{weight value per gray} \times \\ GrayLevel \times \text{number of pixels} \end{array} \right)}{\sum_{GrayLevel=1}^{256} \left( \begin{array}{c} \text{weight value per gray} \times \\ \text{number of pixels} \end{array} \right)}$$

4. The display device as claimed in claim 1, wherein the representative value is an average value of values obtained by multiplying weight values and gray values, after assigning the weight values to the gray values.

5. The display device as claimed in claim 4, wherein the weight values include values which are symmetrical with respect to an intermediate gray value.

6. The display device as claimed in claim 1, wherein the gate driver sequentially applies the gate-on voltage to the gate line and applies one of the first gate-off voltage and the second gate-off voltage in a period where the gate-on voltage is not applied.

7. The display device as claimed in claim 6, further comprising:

a gate-off voltage generator generates the first gate-off voltage and the second gate-off voltage, wherein:

the gate-off voltage generator is divided into a first part generates the first gate-off voltage and a second part generates the second gate-off voltage, the first part and the second part divides a power source voltage using a resistor to generate the first gate-off voltage and the second gate-off voltage, and one of the first part and the second part outputs a variable gate-off voltage includes a digital variable resistor.

8. The display device as claimed in claim 6, wherein:

the first gate-off voltage is applied to the gate line connected to the pixel to which the positive data voltage is applied, and the second gate-off voltage is applied to the gate line connected to the pixel to which the negative data voltage is applied.

9. The display device as claimed in claim 8, wherein:

the first gate-off voltage has a fixed voltage level, and the second gate-off voltage has a voltage level which is varied based on the representative value.

10. The display device as claimed in claim 9, wherein:

a positive voltage between the source and gate, which is a voltage difference between the first gate-off voltage and the common voltage, has a same value as a negative voltage between the source and the gate, which is a voltage difference between the second gate-off voltage and the negative data voltage.

11. The display device as claimed in claim 10, wherein the positive voltage between the source and the gate and the negative voltage between the source and the gate have substantially a same value even when the moving picture is displayed.

12. The display device as claimed in claim 8, wherein the gate line to which first gate-off voltage is applied is adjacent to the gate line to which the second gate-off voltage is applied.

13. The display device as claimed in claim 8, wherein, in a data storing period where the data voltage is not applied, the voltage applied to the data line is lowered based on a kick back voltage.

14. The display device as claimed in claim 1, wherein:

the common voltage is applied to the display panel, and the common voltage has a value which varies in accordance with the moving picture frequency and the still image frequency.

15. The display device as claimed in claim 14, wherein:

the gate driver sequentially applies the gate-on voltage to the gate line and applies one of the first gate-off voltage and the second gate-off voltage in a period where the gate-on voltage is not applied.

16. The display device as claimed in claim 15, further comprising:

a gate-off voltage generator generates the first gate-off voltage and the second gate-off voltage, wherein:

the gate-off voltage generator divides a first part generates the first gate-off voltage and a second part generates the second gate-off voltage, the first part and the second part divide a power source voltage using a resistor to generate the first gate-off voltage and the second gate-off voltage, and one of the first part and the second part which outputs a variable gate-off voltage includes a digital variable resistor.

17. The display device as claimed in claim 15, wherein:

the first gate-off voltage is applied to the gate line connected to the pixel to which the positive data voltage is applied, and the second gate-off voltage is applied to the gate line connected to the pixel to which the negative data voltage is applied.

18. The display device as claimed in claim 17, wherein:

the second gate-off voltage is applied to the gate line connected to the pixel to which the negative data voltage is applied, and the second gate-off voltage has a voltage level which varies based on the representative value.

19. The display device as claimed in claim 18, wherein a positive voltage between the source and gate, corresponding to a voltage difference between the first gate-off voltage and the common voltage, has substantially a same value as a negative voltage between the source and the gate, corresponding to a voltage difference between the second gate-off voltage and the negative data voltage.

20. The display device as claimed in claim 19, wherein the positive voltage between the source and the gate and the negative voltage between the source and the gate have substantially the same value even when the moving picture is displayed.

21. The display device as claimed in claim 18, wherein the first gate-off voltage varies in accordance with the common voltage, which varies to constantly maintain the positive voltage between the source and the gate corresponding to a voltage difference between the first gate-off voltage and the common voltage.

22. The display device as claimed in claim 21, wherein the positive voltage between the source and the gate at the moving picture frequency is substantially equal to the positive voltage between the source and the gate at the still image frequency.

23. The display device as claimed in claim 17, wherein the gate line to which first gate-off voltage is applied is adjacent to the gate line to which the second gate-off voltage is applied.

24. The display device as claimed in claim 17, wherein, in a data storing period where the data voltage is not applied, the voltage applied to the data line is lowered based on a kick back voltage.

25. The display device as claimed in claim 1, wherein, in a data storing period where the data voltage is not applied, the voltage which is applied to the data line is lowered based on a kick back voltage.

26. A driving method of a display device, the driving method comprising:

receiving input data;

distinguishing whether the input data corresponds to a moving picture or a still image; and if the input data is a still image, controlling a display panel, a gate driver, and a data driver to display the still image at a still image frequency, and if the input data is a moving picture, controlling the display panel, the gate driver, and the data driver to display the moving picture at a moving picture frequency, wherein:

when the still image is displayed, controlling the gate driver to sequentially apply a gate-on voltage to the gate line and to apply one of a first gate-off voltage and a second gate-off voltage in a period where the gate-on voltage is not applied, the first gate-off voltage is applied to the gate line connected to the pixel to which a positive data voltage is applied, the second gate-off voltage is applied to the gate line connected to the pixel to which a negative data voltage is applied, and the second gate-off voltage has a voltage level which varies based on a representative value of the input data.

27. The driving method as claimed in claim 26, wherein distinguishing whether the input data is the moving picture or the still image is performed based on a panel self refresh signal.

28. The driving method as claimed in claim 26, wherein:

the representative value is an average gray value of the image data which is applied to all of the pixels for one frame and satisfies the following equation:

$$\text{Average gray value} = \frac{\sum_{GrayLevel=1}^{256} \left( \begin{array}{c} \text{weight value per gray} \times \\ GrayLevel \times \text{number of pixels} \end{array} \right)}{\sum_{GrayLevel=1}^{256} \left( \begin{array}{c} \text{weight value per gray} \times \\ \text{number of pixels} \end{array} \right)}$$

29. The driving method as claimed in claim 26, wherein the representative value is an average gray value of the image data which is applied to the pixel connected to the gate line for one frame and satisfies the following equation:

$$\text{Average gray value} = \frac{\sum_{GrayLevel=1}^{256} \left( \begin{array}{c} \text{weight value per gray} \times \\ GrayLevel \times \text{number of pixels} \end{array} \right)}{\sum_{GrayLevel=1}^{256} \left( \begin{array}{c} \text{weight value per gray} \times \\ \text{number of pixels} \end{array} \right)}$$

30. The driving method as claimed in claim 26, wherein the representative value is an average value of values obtained by multiplying weight values and gray values, after assigning the weight values to the gray values.

31. The driving method as claimed in claim 30, wherein the weight values are symmetrical to each other with respect to an intermediate gray value.

32. The driving method as claimed in claim 26, wherein:

the first gate-off voltage has a fixed voltage level, and the second gate-off voltage has a voltage level which varies based on the representative value.

33. The driving method as claimed in claim 32, wherein a positive voltage between the source and gate, corresponding to a voltage difference between the first gate-off voltage and the common voltage, has substantially a same value as a negative voltage between the source and the gate, corresponding to the voltage difference between the second gate-off voltage and the negative data voltage.

34. The driving method as claimed in claim 33, wherein the positive voltage between the source and the gate and the negative voltage between the source and the gate have substantially a same value even when the moving picture is displayed.

35. The driving method as claimed in claim 26, wherein the gate line to which first gate-off voltage is applied is adjacent to the gate line to which the second gate-off voltage is applied.

36. The driving method as claimed in claim 26, further comprising:

lowering a voltage applied to the data line based on a kick back voltage in the data storing period where the data voltage is not applied.

37. The driving method as claimed in claim 26, wherein:

the common voltage is applied to the display panel, and the common voltage has a value which varies in accordance with the moving picture frequency and the still image frequency.

38. The driving method as claimed in claim 37, wherein the first gate-off voltage varies in accordance with the common voltage, which varies so as to constantly maintain the positive voltage between the source and the gate corresponding to a voltage difference between the first gate-off voltage and the common voltage.

* * * * *